US011072352B2

(12) United States Patent
Coseglia

(10) Patent No.: US 11,072,352 B2
(45) Date of Patent: Jul. 27, 2021

(54) RAILCAR TRUCK BOLSTER

(71) Applicant: AMSTED RAIL COMPANY, INC., Chicago, IL (US)

(72) Inventor: John Coseglia, Edwardsville, IL (US)

(73) Assignee: AMSTED RAIL COMPANY, INC., Chicago, IL (US)

( * ) Notice: Subject to any disclaimer, the term of this patent is extended or adjusted under 35 U.S.C. 154(b) by 390 days.

(21) Appl. No.: 16/217,780

(22) Filed: Dec. 12, 2018

(65) Prior Publication Data

US 2019/0315379 A1 Oct. 17, 2019

Related U.S. Application Data

(60) Provisional application No. 62/597,992, filed on Dec. 13, 2017.

(51) Int. Cl.

| | |
|---|---|
| ***B61F 5/12*** | (2006.01) |
| ***B61F 5/02*** | (2006.01) |
| *B61F 5/50* | (2006.01) |

(52) U.S. Cl.

CPC ..... *B61F 5/122* (2013.01); *B61F 5/02* (2013.01); *B61F 5/50* (2013.01)

(58) Field of Classification Search

CPC .... B61F 5/122; B61F 5/04; B61F 5/02; B61F 5/12; B61F 5/14; B61F 5/32; B61F 5/50

USPC ..... 105/198.2, 225, 193, 198.4, 198.5, 200, 105/207

See application file for complete search history.

(56) References Cited

U.S. PATENT DOCUMENTS

| | | | | |
|---|---|---|---|---|
| 3,654,871 | A * | 4/1972 | Wallace | B61F 5/06 105/198.4 |
| 3,690,270 | A * | 9/1972 | Gutmann, Jr. | B61F 5/06 105/198.4 |
| 4,084,514 | A | 4/1978 | Bullock | |
| 4,274,340 | A | 6/1981 | Neumann et al. | |
| 5,239,932 | A * | 8/1993 | Weber | B61F 5/122 105/198.2 |
| 6,425,334 | B1 | 7/2002 | Wronkiewicz et al. | |
| 7,077,411 | B2 * | 7/2006 | Peters | B60G 5/02 280/124.132 |
| 10,543,858 | B2 | 1/2020 | Coseglia | |
| 2010/0043668 | A1 * | 2/2010 | Wolinski | B61F 5/122 105/198.4 |
| 2018/0265101 | A1 * | 9/2018 | Coseglia | B61F 5/16 |

OTHER PUBLICATIONS

International Search Report and Written Opinion in corresponding International Application No. PCT/US18/65203, dated Mar. 15, 2019, 10 pages.

* cited by examiner

*Primary Examiner* — Zachary L Kuhfuss
*Assistant Examiner* — Cheng Lin
(74) *Attorney, Agent, or Firm* — Amsted Industries Incorporated

(57) ABSTRACT

A rail car truck bolster wear plate surface connects to a wear plate using two fasteners of different length. The first fastener passes through an upper opening and an upper channel into a first recess where it can be tightened against a first engaging surface. The second fastener is longer than the first fastener and passes through a lower opening and lower channel into a second recess adjacent to the first recess. The surfaces of the first and second recesses form a series of ribs in the upper end surface between the wear plate surface and the longitudinal centerline of the bolster.

12 Claims, 6 Drawing Sheets

RAILCAR TRUCK BOLSTER

RELATED APPLICATION

This application claims the benefit of U.S. provisional patent application No. 62/597,992, filed on Dec. 13, 2017, and titled "RAILCAR TRUCK BOLSTER," which is hereby incorporated by reference in its entirety.

TECHNICAL FIELD

This application relates to railcar truck bolsters. More specifically, this application relates to implementations for attaching friction shoe wear plates to a railcar truck bolster.

BACKGROUND

Railway vehicles traditionally include a car body that rides on top of a chassis or framework referred to as a truck, which serve as a modular subassembly of wheels and axles. A traditional rail truck includes two side frames that run parallel to the direction of travel of the truck. A pair of wheel sets span between and support each side frame at respective end locations. Each wheel set includes an axle that runs generally perpendicular to the side frames, and a pair of wheels at each end of the axle. A bolster also spans across the side frames, typically in a central location of the truck, linking the side frames together. The bolster is also used to support or carry the car body, often via a bowl assembly (called a center bowl), positioned on an upper surface at the center of the bolster.

Friction wedges are used in railroad car trucks to dampen movement of the bolster with respect to the side frame of the railroad car truck. Friction wedges are often triangular-shaped such that the friction wedge can act as a wedge between an inclined surface of the bolster and a generally vertical wear plate on a column of the side frame. The friction wedge is wedged into engagement between the bolster and the column of the side frame by a suspension spring. The frictional forces generated between the friction wedge and a wear plate on the side frame provides dampening of bolster movement.

Bolster friction shoe wear plates are typically either welded or bolted onto the bolster. In bolsters where the wear plates are bolted on, multiple bolts typically extend into the interior of the bolster and are accessible through small holes in the top member, thereby making assembly, and in particular, attachment of the wear plate difficult.

This application describes an implementation for attaching a wear plate to a wear surface of a rail car truck bolster. In particular, this application describes a bolster wear plate connection surface that allows for a bolted connection of a wear plate using multiple bolts of different lengths. A shorter bolt extends through an upper orifice of the wear plate and the wear plate surface and through a first recess in an upper surface of the bolster. A second, longer bolt extends through a lower orifice and the wear plate surface and through a second recess in the upper surface of the bolster. Both the first and second recesses are positioned at relatively the same level, and allow for the bolt to be tightened with a corresponding nut or other connecter in a similar fashion. That is, because the lower bolt is connected in a second recess separate from the first recess, the corresponding connector can be tightened without having to navigate through a small opening in the upper bolster surface and around the stem and connector of the upper bolt.

Bolster friction shoe wear plates wear plates are typically either welded or bolted onto the bolster. In bolsters where the wear plates are bolted on, multiple bolts typically extend into the interior of the bolster and are accessible through small holes in the top member, thereby making assembly, and in particular, attachment of the wear plate difficult. Such an example is shown in FIGS. 2A-D and 7. In this example, the bolster 20 has a bolster end 22 with an upper surface 23, multiple attachment openings 24, and wear plate surface 26. Fasteners pass through an upper bolt hole 25 (which can be a channel or other throughway designed to receive a fastener) and a lower bolt hole 27 that extends between the wear plate surface and an engaging surface 29 within the access opening 24. This allows a wear plate to attach to the wear plate surface 26 of the bolster. In such a design, the fasteners are equally short and accessed through a common hole 24. This makes attachment difficult, especially for the lower fastener, as it can be difficult to place tooling deep into the narrow opening while avoiding the first fastener.

SUMMARY

This application describes a rail car truck bolster. The bolster has a first end configured to engage with a side frame of the rail car truck. The first end has an upper surface that extends generally parallel with an upper surface of the rail car truck bolster. The first end also has at least one wear plate surface configured to engage with a wear plate. The wear plate surface extends downward from the upper surface at an angle (e.g., 45 degrees). The wear plate surface includes at least two openings which serve as clearance holes (also referred to as bolt holes) through which the fasteners pass, including an upper opening and a lower opening. The upper surface also has at least two recesses, including a first recess and a second recess. The first and second recesses each have an engaging surface with an opening through which a fastener passes and which is parallel to the wear plate surface against which a fastener can be tightened, and a second surface at an angle (e.g., generally perpendicular) relative to the first. The two form an inverted "V" shape. This configuration allows the fasteners to be accessible from the top of this bolster and eliminates the need for an access hole, thereby improving the strength and/or integrity of the bolster end. An upper channel designed to receive a first fastener (e.g., a bolt) extends between the upper opening of the wear plate surface and the first engaging surface of the first recess of the upper surface. Likewise, a lower channel designed to receive a second fastener extends between the lower opening of the wear late surface and the second engaging surface of the second recess of the upper surface. The lower channel and the second fastener are longer than the first channel/fastener because of the greater distance between the upper surface of the bolster and the respective openings. Despite this difference in length, each fastener extends within a separate recess at a relatively equal distance relative to the upper surface. This facilitates the installation of the respective fasteners while also providing structural integrity of the bolster.

DETAILED DESCRIPTION

Figure 1:
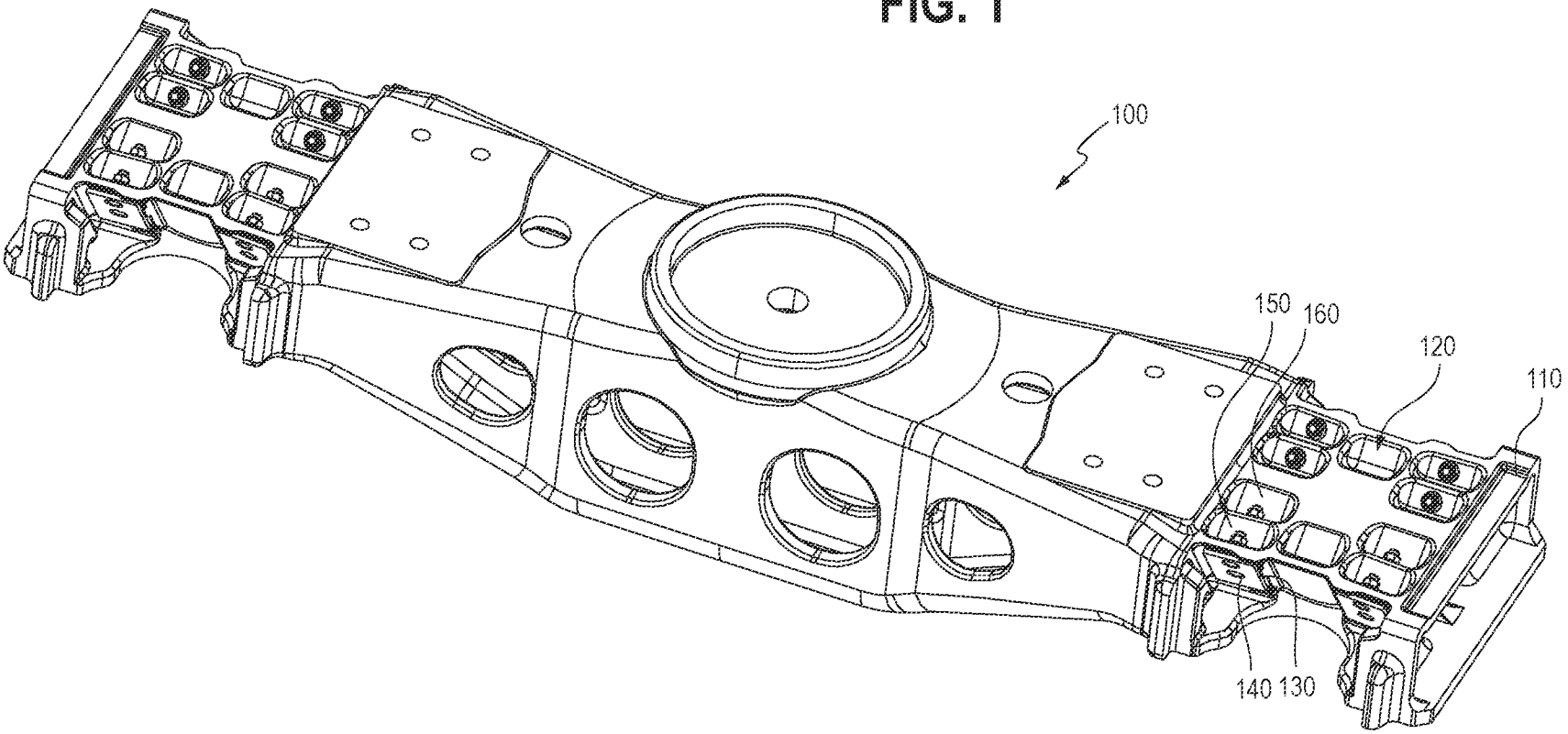
FIG. 1 is an isometric view of a bolster having a wear plate connection design according to examples described herein.
Figure 2A:
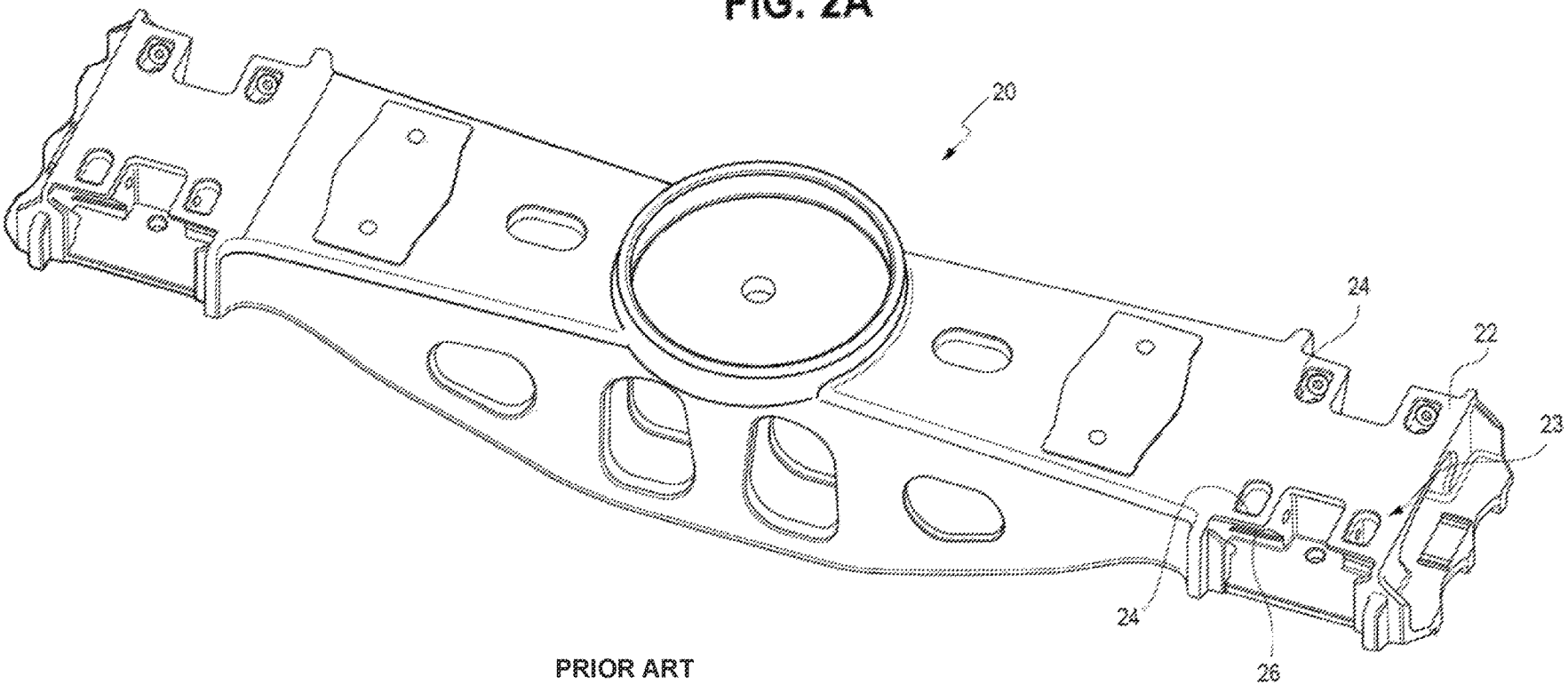
FIG. 2A PRIOR ART
FIGS. 2A-2D provide various views of a comparative bolster that has multiple bolts extending into a hole in the top member.
Figure 2D:
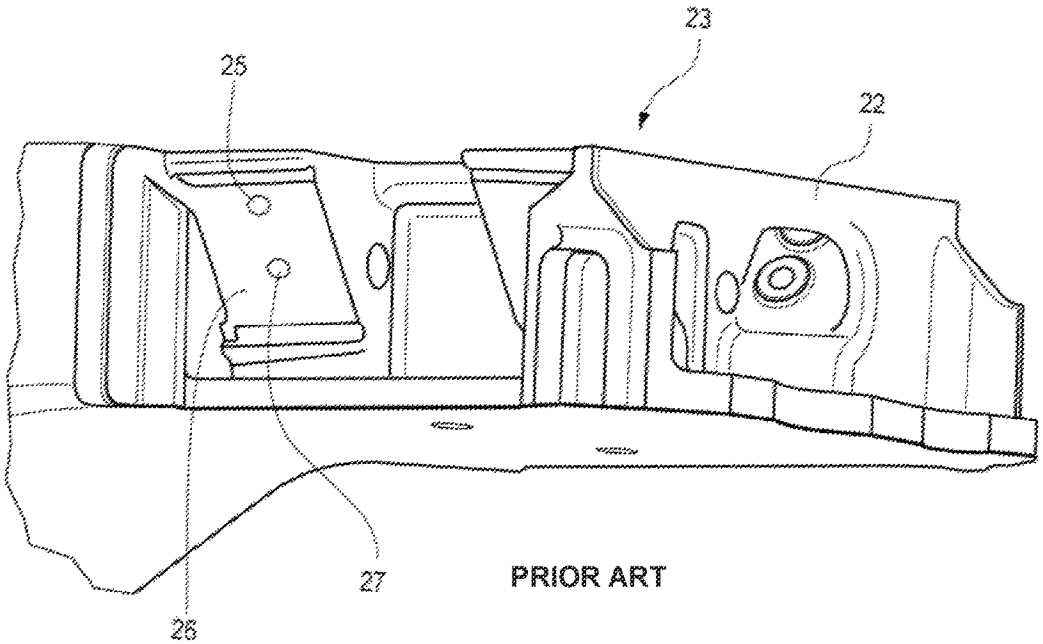
FIG. 2D PRIOR ART
Figure 2B:
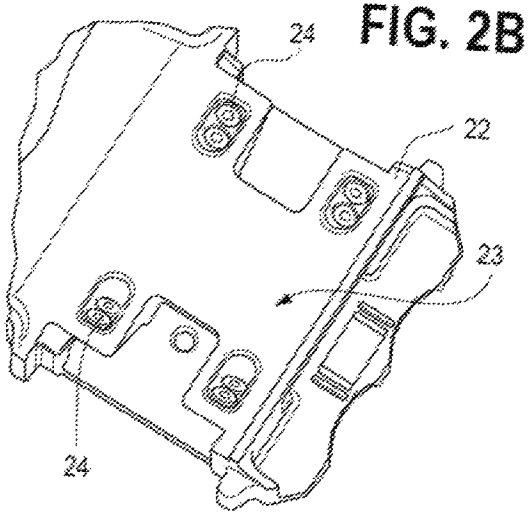
FIG. 2B PRIOR ART
Figure 2C:
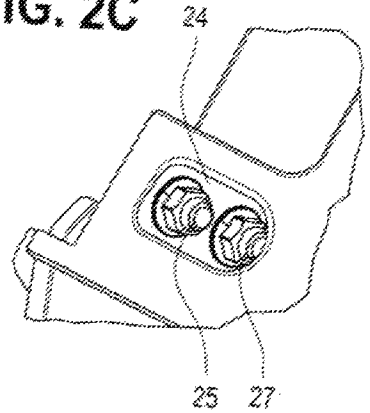
FIG. 2C PRIOR ART
Figure 4:
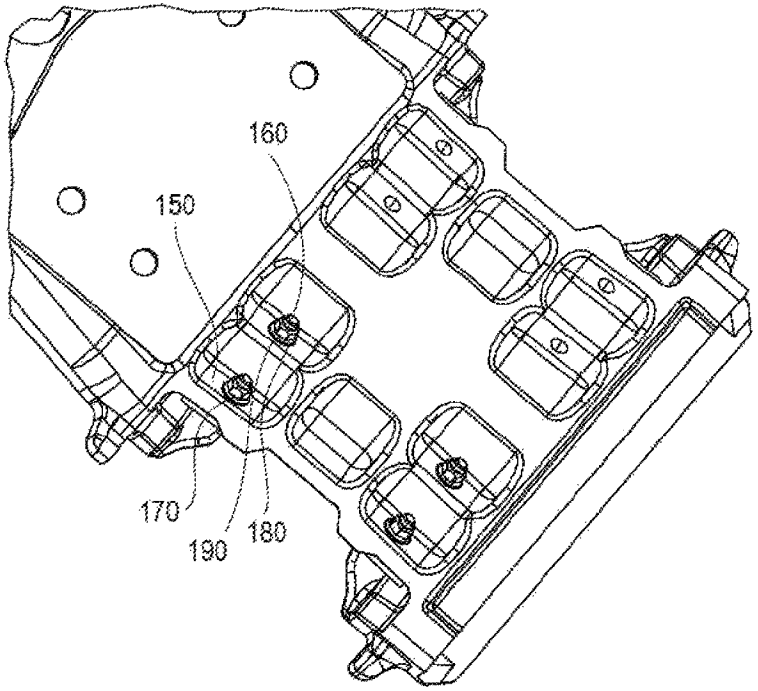
FIG. 4 is a close up top view of bolster end of FIG. 3.
Figure 3:
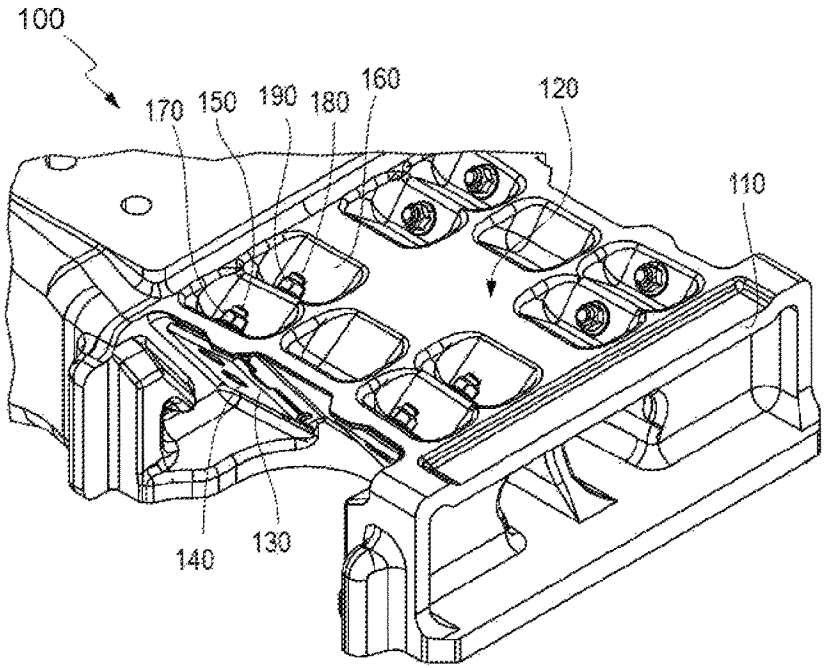
FIG. 3 is a close up isometric view of an end of the bolster of FIG. 1
Figure 6:
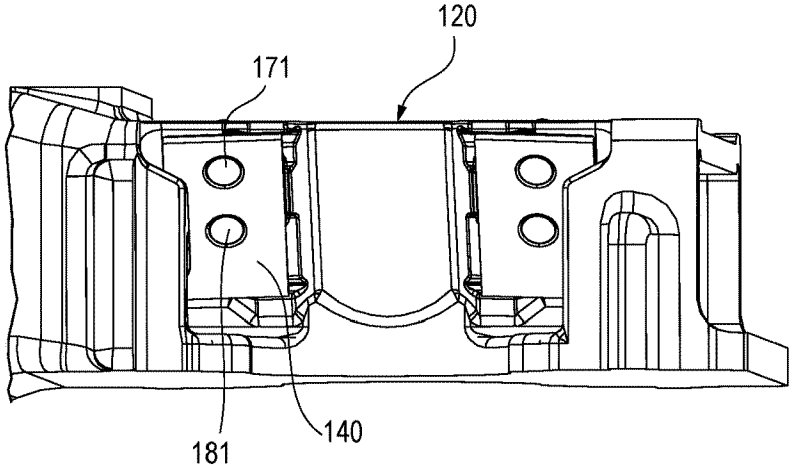
FIG. 6 is a side view of the bolster end of FIG. 3, also showing the wear plates installed.
Figure 5:
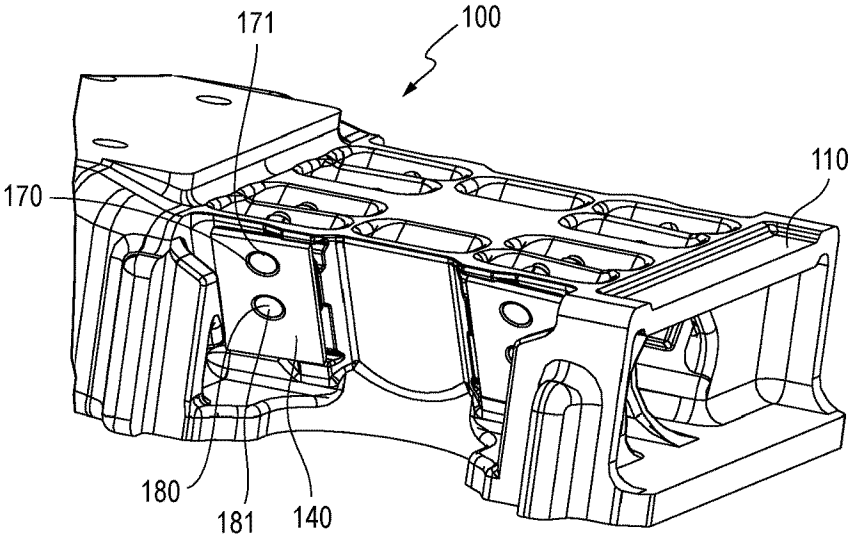
FIG. 5 is an isometric close up view of the bolster end of FIG. 3 showing a wear plates installed.

For example, such designs with two bolts per plate used relatively small bolts approximately 2" (50 mm) in overall length, which left approximately 1" (25 mm) of the bolt in tension, and were 0.5" (12.7 mm) in diameter in addition to this the threads ran up to the head. As a result the tensile stresses in the bolt were spread over a short length and concentrated under the head and could easily be overloaded. Larger wear plate retention "lips" around the wear plate to prevent the wear plate from coming out in the event that the bolts should break. But these can be difficult to manufacture and maintain quality as special tools were required to reach into small corners of the casting.

FIGS. 1 3-6 and 8 provide various views of a bolster 100 having a wear plate connection design that improves both assembly and structural integrity of the bolster.

As shown in these Figures, the bolster 100 has a first end 110 configured to engage with a side frame of the rail car truck. The first end 110 has an upper surface 120 that extends generally parallel with the upper surface of the bolster 100. The first end 110 has multiple wear plate surfaces 130, which are designed to engage with a wear plate 140.

The wear plate surface 130 extends downward from the upper surface at an angle (e.g., 45 degrees). The wear plate surface 130 includes at least two openings, including an upper bolt hole 171 and a lower bolt hole 181.

The upper surface 120 also multiple recesses or depressions, including a first recess 150 and a second recess 160. The first and second recesses 150/160 each have an engaging surface 152/162 against which a connector (e.g., a nut) can be tightened or torqued. The engaging surfaces 152/162 may be generally parallel with the wear plate surface 130. The second engaging surface 162 is generally positioned between a reclining surface of the first 150 recess and the second 160 recess, and forms a V-shaped rib 190, or a bend that maintains the strength or helps strengthen the bolster 100. The reclining surfaces of the recesses 150/160 may extend generally perpendicular to the engaging surfaces 152/162. The recesses 150/160 and the corresponding engaging surfaces/reclining surfaces may form a W-shaped pattern that contributes to the strength or integrity of the bolster end 110.

An upper bolt hole 170 designed to receive a first fastener 174 (e.g., a bolt) extends between the upper opening 171 of the wear plate surface 130 and the first engaging surface 142 of the first recess 150. Likewise, a lower bolt hole 180 designed to receive a second fastener 184 extends between the lower opening 181 of the wear plate surface 130 and the second engaging surface 162 of the second recess 160. The lower 180 bolt hole and the second fastener 184 are longer than the upper bolt hole 170 and the first fastener 174 because of the greater distance between the upper surface 120 of the bolster 100 and the respective openings 171/181. Despite this difference in length, each fastener 174/184 extends within a separate recess 150/160 at a relatively equal distance relative to the upper surface 120. This facilitates the installation of the respective fasteners 174/184 while also providing structural integrity of the bolster 100.

Figure 8:
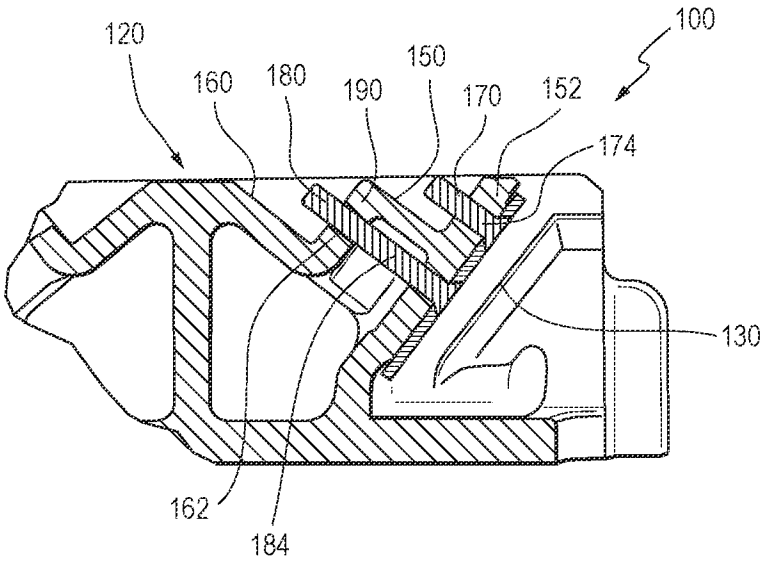
FIG. 8 is a cross sectional view of the wear plate connection implementation of the bolster of FIG. 1, using two different fasteners of differing lengths.
Figure 7:
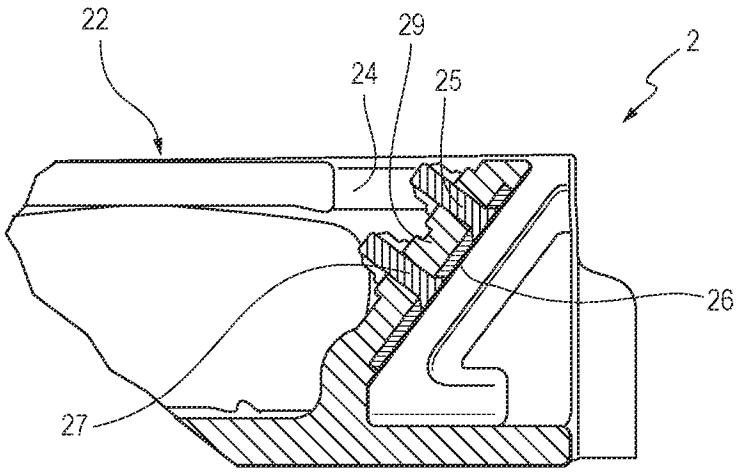
FIG. 7 PRIOR ART
FIG. 7 is a comparative cross sectional view of the wear plate connection implementation of the bolster of FIGS. 2A-2D, using fasteners of the same length.

FIGS. 7 and 8 contrast the cross sections of the two different bolsters 2 and 100. The second fastener 184 within the lower bolt hole 180 of bolster 100 of FIG. 8 is far more accessible than its counterpart 27 of the bolster 2 of FIG. 7 because the connection device (e.g., a nut) is closer to the upper surface 120 of the bolster. Moreover, because the second fastener 184 is within its own recess 160, the first fastener 174 does not interfere with the tightening or other installation procedures of the second fastener 184. Moreover, the second engaging surface 182, against which any connection device can be tightened, forms a part of a bend that improves structural integrity of the bolster 100 as compared to the access holes 24 in bolster 100.

According to the described designs, the wear plate fasteners 174/184 (e.g., bolts and nuts) are easily accessible without reaching through small holes 24 in the top of the bolster 100. The fasteners extend through the bolster but do not protrude above the top surface 120 of the bolster end 110. The recesses 150/160 are configured to be large enough for wrench clearance. The bolster structural integrity is maintained as there are no fastener access holes, only the bolt hole which passes thru the bolster sloped surface and the top of the bolster compression forces exerted on the bolster by the bolts are supported by ribs cast in the inside of the bolster.

Certain examples of the bolsters described herein utilize two bolts per plate the upper bolt is approximately 2" (50 mm) in length and has a full diameter shank approximately 0.25" (6.4 mm) between the head and threads for improved strength and the lower bolt is approximately 4" (100 mm) in length.

Certain examples of the described bolster design also use safety "tabs" which are sufficient to retain the plate in the unlikely event that both bolts break, but do not extend into the corners of the bolster friction shoe pocket and are more accessible to be dressed with standard casting finishing tools.

This application also describes methods installing a wear plate onto a rail car truck bolster. The method can involve installing a wear plate onto the various examples of rail car truck bolsters described above. In one example, the method includes inserting a first fastener through a first lower bolt hole so that a distal end of the first fastener extends into the first recess. The method also includes inserting a second fastener through the second lower bolt hole so that a distal end of the second fastener extends into the second recess. The first faster is secured by applying a first connector (e.g., a nut) to the distal end of the first fastener and tightening the first connector against the reclining surface of the first recess. The second fastener is also secured by applying a second connector to the distal end of the second fastener and tightening the second connector against the reclining surface of the second recess. In some cases, the second fastener is longer than the first fastener.

This application describes preferred embodiments and examples of rail car truck bolsters and related wear plate connection implementations and is illustrative but not limiting. Those skilled in the art will recognize that the described examples could be modified and/or combined with one another without departing from the scope described herein. Further, features of one embodiment or example may be combined with features of other embodiments or examples to provide still further embodiments or examples as desired. All references that this application cites, discusses, identifies, or refers to are hereby incorporated by reference in their entirety.

The invention claimed is:

1. A rail car truck bolster comprising:

a first end configured to engage with a side frame of a rail car truck, the first end having:

an upper end surface extending generally parallel with an upper surface of the rail car truck bolster;

at least one wear plate surface configured to engage with a wear plate, the wear plate surface extending downward from the upper surface at an angle, the wear plate surface comprising an upper bolt hole and a lower bolt hole;

a first recess within the upper end surface, the first recess having a first engaging surface extending generally parallel to the wear plate surface and a first reclining surface extending generally perpendicular to the first engaging surface, and a second recess within the upper end surface, the second recess having a second engaging surface extending generally parallel with the wear plate surface and the first wear plate surface and a reclining surface extending generally perpendicular to the second engaging surface;

wherein the first and second engaging surface and the first and second reclining surfaces collectively form ribs arranged in a W-shaped cross section.

2. The rail car truck bolster of claim 1, wherein the second engaging surface extends between the first reclining surface and the second reclining surface.

3. The rail car truck bolster of claim 2, wherein the upper bolt hole extends between the wear plate surface and the first engaging surface of the first recess of the upper end surface, and wherein the lower bolt hole extending between the wear plate surface and the second engaging surface of the second recess of the upper end surface.

4. The rail car truck bolster of claim 3, wherein the upper bolt hole is configured to receive a first fastener and the lower bolt hole is configured to receive a second fastener longer than the first fastener to attach the wear plate to the wear plate surface.

5. The rail car truck of claim 1, wherein the first fastener is received within the upper bolt hole and the second fastener is received within the lower bolt hole.

6. The rail car truck of claim 5, wherein the second fastener is longer than the first fastener.

7. A rail car truck comprising a first and second side frame, a bolster, the bolster comprising:

a first end configured to engage with the first side frame and a second end configured to engage with the second side frame, the first end having:

an upper end surface extending generally parallel with an upper surface of the rail car truck bolster;

at least one wear plate surface, the wear plate surface extending downward from the upper surface at an angle, the wear plate surface comprising an upper bolt hole and a lower bolt hole;

a first recess within the upper end surface, the first recess having a first engaging surface extending generally parallel to the wear plate surface and a first reclining surface extending generally perpendicular to the first engaging surface, and a second recess within the upper end surface, the second recess having a second engaging surface extending generally parallel with the wear plate surface and the first wear plate surface and a reclining surface extending generally perpendicular to the second engaging surface; and a wear plate engaged to the wear plate surface via at least a first and second fastener; and a friction wedge configured to engage with the wear plate;

wherein the first and second engaging surface and the first and second reclining surfaces collectively form ribs arranged in a W-shaped cross section.

8. The rail car truck of claim 7, wherein the second engaging surface extends between the first reclining surface and the second reclining surface.

9. The rail car truck of claim 8, wherein the upper bolt hole extends between the wear plate surface and the first engaging surface of the first recess of the upper end surface, and wherein the lower bolt hole extending between the wear plate surface and the second engaging surface of the second recess of the upper end surface.

10. The rail car truck of claim 7, wherein the second end also includes:

an upper end surface extending generally parallel with an upper surface of the rail car truck bolster;

at least one wear plate surface configured to engage with a wear plate, the wear plate surface extending downward from the upper surface at an angle, the wear plate surface comprising an upper bolt hole and a lower bolt hole;

a first recess within the upper end surface, the first recess having a first engaging surface extending generally parallel to the wear plate surface and a first reclining surface extending generally perpendicular to the first engaging surface, and a second recess within the upper end surface, the second recess having a second engaging surface extending generally parallel with the wear plate surface and the first wear plate surface and a reclining surface extending generally perpendicular to the second engaging surface, wherein the upper bolt hole of the second end extends between the wear plate surface of the second end and the first engaging surface of the first recess of the upper end surface of the second end, and wherein the lower bolt hole of the second end extends between the wear plate surface of the second end and the second engaging surface of the second recess of the upper end surface of the second end.

11. A method of installing a wear plate onto a rail car truck bolster, the rail car truck bolster having a first end that engages with a side frame of a rail car, the first end having an upper end surface extending generally parallel with an upper surface of the bolster, wear plate surface extending downward from the upper surface at an angle, the wear plate surface comprising an upper bolt hole and a lower bolt hole, and a first and second recess within the upper end surface, the method comprising:

inserting a first fastener through a first lower bolt hole so that a distal end of the first fastener extends into the first recess, inserting a second fastener through the second lower bolt hole so that a distal end of the second fastener extends into the second recess, securing the first fastener by applying a first connector to the distal end of the first fastener and tightening the first connector against a first reclining surface of the first recess, and securing the second fastener by applying a second connector to the distal end of the second fastener and tightening the second connector against a second reclining surface of the second recess, wherein the second fastener is longer than the first fastener.

12. A rail car truck bolster comprising:

a first end configured to engage with a side frame of a rail car truck, the first end having:

a first end configured to engage with a side frame of a rail car truck, the first end having:

an upper end surface extending generally parallel with an upper surface of the rail car truck bolster;

at least one wear plate surface configured to engage with a wear plate, the wear plate surface extending downward from the upper surface at an angle, the wear plate surface comprising an upper bolt hole and a lower bolt hole;

a first recess within the upper end surface, the first recess having a first engaging surface extending generally parallel to the wear plate surface and a first reclining surface extending generally perpendicular to the first engaging surface, and a second recess within the upper end surface, the second recess having a second engaging surface extending generally parallel with the wear plate surface and the first wear plate surface and a reclining surface extending generally perpendicular to the second engaging surface;

wherein the first and second engaging surface and the first and second reclining surfaces collectively form ribs arranged in a W-shaped cross section wherein the upper bolt hole extends between the wear plate surface and the first engaging surface of the first recess of the upper end surface, and wherein the lower bolt hole extending between the wear plate surface and the second engaging surface of the second recess of the upper end surface wherein the upper bolt hole is configured to receive a first fastener and the lower bolt hole is configured to receive a second fastener longer than the first fastener to attach a wear plate to the wear plate surface.

* * * * *